United States Patent [19]

Hess

[11] 4,132,485

[45] Jan. 2, 1979

[54] INK RIBBON CARTRIDGE WITH CONSTANT TENSION MECHANISM

[75] Inventor: Ernst P. Hess, Castro Valley, Calif.

[73] Assignee: Qume Corporation, Hayward, Calif.

[21] Appl. No.: 603,411

[22] Filed: Aug. 11, 1975

Related U.S. Application Data

[63] Continuation of Ser. No. 449,131, Mar. 7, 1974, abandoned.

[51] Int. Cl.[2] ..... B41J 33/04

[52] U.S. Cl. ..... 400/208; 400/234

[58] Field of Search ..... 197/151, 154, 168, 172; 242/156.1; 226/195; 400/208, 229, 234

[56] References Cited

U.S. PATENT DOCUMENTS

| | | | |
|---|---|---|---|
| 222,416 | 12/1879 | McCormick | 242/156.1 |
| 2,657,157 | 10/1953 | Francis | 197/172 UX |
| 3,349,887 | 10/1967 | Goff | 197/151 |
| 3,356,202 | 12/1967 | Goff | 197/151 |
| 3,432,020 | 3/1969 | Caudill et al. | 197/151 |
| 3,604,549 | 9/1971 | Caudill et al. | 197/151 |
| 3,731,781 | 5/1973 | Caudill et al. | 197/151 |
| 3,833,108 | 9/1974 | Von Daeniken | 197/151 |
| 3,863,749 | 2/1975 | Perry et al. | 197/151 |

FOREIGN PATENT DOCUMENTS

| | | | |
|---|---|---|---|
| 223214 | 9/1962 | Austria | 197/151 |
| 1029648 | 6/1953 | France | 197/151 |
| 1313210 | 11/1962 | France | 242/156.1 |
| 758290 | 10/1956 | United Kingdom | 197/151 |
| 1033667 | 6/1966 | United Kingdom | 197/151 |

*Primary Examiner*—Paul T. Sewell

*Attorney, Agent, or Firm*—Townsend and Townsend

[57] ABSTRACT

A low cost cartridge for supplying inked ribbon to the printing station of an associated printing device. The cartridge includes an internal tensioning mechanism for maintaining the length of inked ribbon positioned in the printing station at a constant tension independently of the quantity of ribbon remaining on the supply reel in the cartridge. The tensioning mechanism includes an elastic endless belt disposed in a closed path about a plurality of freely rotatable rollers, the path having an interference region in which portions of the belt are engaged by a portion of the outer layer of supply reel mounted ribbon and are deflected thereby to produce a drag force on the supply reel which varies with the pulling force required to withdraw ribbon from the supply reel.

13 Claims, 6 Drawing Figures

INK RIBBON CARTRIDGE WITH CONSTANT TENSION MECHANISM

This is a continuation of application Ser. No. 449,131, filed 3/7/74, now abandoned.

BACKGROUND OF THE INVENTION

This invention relates to cartridges having a supply reel and a take-up reel for carrying an inked ribbon which is translated from reel to reel. More particularly, this invention relates to inked ribbon cartridges having a ribbon tension control device included therewithin.

Inked ribbon cartridges are known which supply an inked ribbon to a printing station of an associated printing device, e.g., a rotary printer or a typewriter. In typical devices of this type, the cartridge is provided with a supply reel about which the ribbon is wound, a take-up reel for storing used portions of the ribbon, and a drive mechanism for advancing the inked ribbon from the supply reel past the printing station and onto the take-up reel.

In order to maintain the print quality of the characters printed at the station substantially uniform, the tension of that portion of the inked ribbon located in the printing station must be maintained substantially constant in order to preclude stretching or contracting of this portion of the ribbon. Among other factors, the extent to which the ribbon is stretched or contracted is dependent upon the pulling force required to withdraw fresh ribbon from the supply reel. In typical cartridges, this pulling force is not constant, but varies with the quantity of ribbon remaining on the supply reel.

Since an inked ribbon cartridge is normally designed as a disposable item, any ribbon tensioning mechanism should preferably embody a minimum number of working elements in order to maintain the manufacturing cost at a minimum, while at the same time must provide substantially uniform tension at the printing station, regardless of the amount of the inked ribbon which has been removed from the supply reel. In addition, the ribbon tensioning mechanism must not alter the ink density of the ribbon as it is payed out from the supply reel, since such alteration can readily result in printed characters of varying density. To date, efforts to design a low cost inked ribbon cartridge meeting the above criteria have not met with wide success.

SUMMARY OF THE INVENTION

The invention comprises an inked ribbon cartridge having a tension control mechanism which provides substantially constant ribbon tension regardless of the quantity of ribbon on the supply reel, and which is extremely simple to fabricate, rugged in construction, and highly reliable in performance. In the preferred embodiment, the cartridge includes a housing having an exit slot and an entrance slot, a freely rotatable ribbon supply reel, a power driven ribbon take-up reel, means for transporting the ribbon from the supply reel via the exit and entrance slots to the take-up reel and means for providing substantially constant ribbon tension regardless of the quantity of ribbon on the supply reel. The ribbon transport means includes a power driven rotatable ribbon capstan having a ribbon gripping surface enclosed between a pair of axially spaced guide flanges, a freely rotatable pinch roller having a ribbon gripping surface, and a pinch roller biasing mechanism for urging the pinch roller against the ribbon capstan to firmly grasp the ribbon therebetween. The ribbon tensioning mechanism comprises an endless elastic belt disposed about a plurality of freely rotatable rollers, the latter defining a belt path having an interference region in which the outer surface of a portion of the endless belt is maintained in surface contact with the outer surface of a portion of the outermost layer of the ribbon on the supply reel to provide a drag force thereon.

In operation, the ribbon capstan and take-up reel are driven by a power source and the ribbon is pulled from the supply reel and gathered on the take-up reel. Rotation of the supply reel in response to the capstan pulling force causes the endless belt to travel along the belt path by virtue of the friction between the outermost ribbon layer and endless belt portions in the interference region. When the supply reel is full, the endless belt is stretched a maximal amount to provide a maximum drag force on the supply reel. As the ribbon is payed out from the supply reel, the belt slackens due to its elasticity, thereby reducing the drag force on the supply reel. Since the pulling force and the drag force are both dependent on the ribbon supply radius, the ribbon tension remains substantially constant as the supply reel is emptied. Since no sliding friction occurs between the belt and the ribbon, the ribbon ink density is substantially unaltered during reeling of the ribbon.

The supply reel, take-up reel and ribbon capstan are each provided with an end shaft which protrudes exteriorly of the cartridge housing to facilitate ribbon installation and initial set-up.

For a fuller understanding of the nature and advantages of the invention, reference should be had to the ensuing detailed description taken in conjunction with the accompanying drawings.

DESCRIPTION OF THE PREFERRED EMBODIMENT

Figure 1:
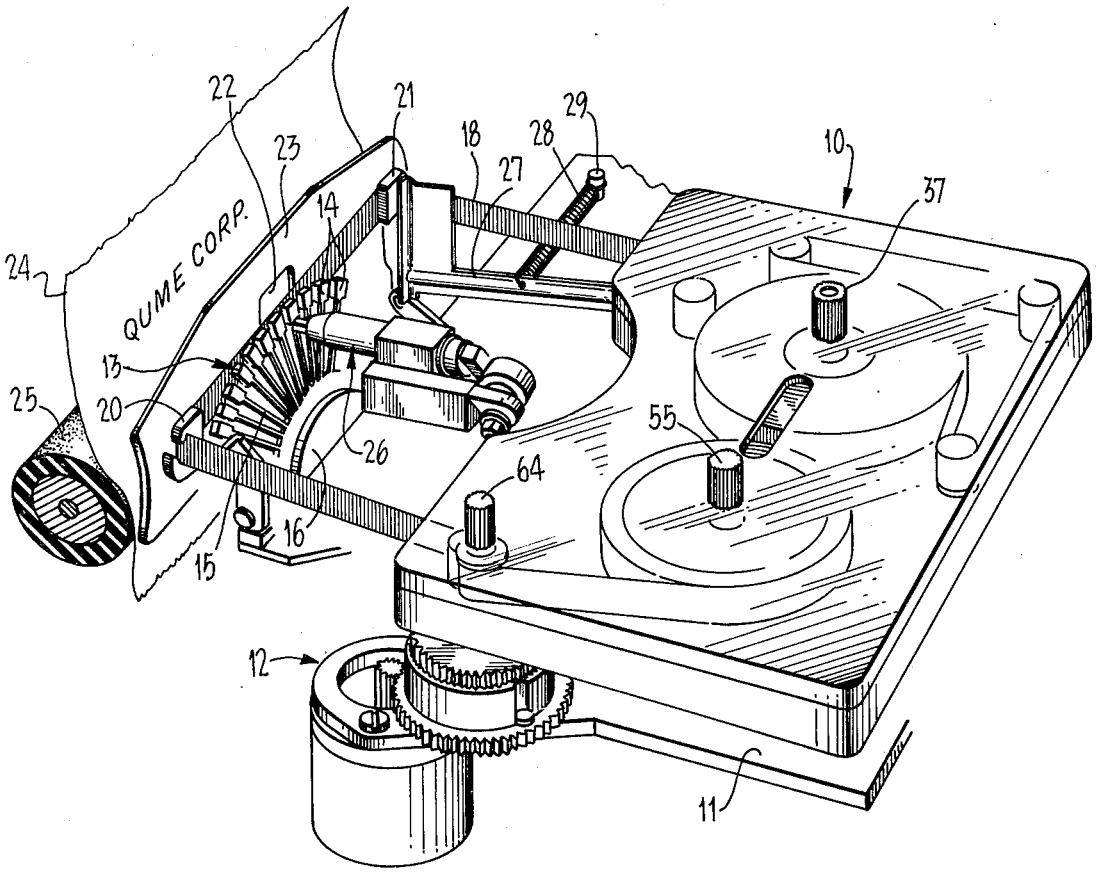
FIG. 1 is a perspective view of the preferred embodiment of the invention.

Turning now to the drawings, FIG. 1 is a perspective view illustrating the preferred embodiment of the invention mounted for operative association with a printing device. As seen in this FIG., an inked ribbon cartridge 10 is mounted on a platform 11 provided with a suitable drive mechanism indicated by reference numeral 12. Drive mechanism 12 is preferably an incremental ribbon capstan and take-up reel drive mechanism of the type disclosed and claimed in my co-pending application for "CARTRIDGE DRIVE APPARATUS", Ser. No. 448,848 filed Mar. 7, 1974, filed the disclosure of which is hereby incorporated by reference. Other suitable compatible drive arrangements may be employed as desired.

As shown, the cartridge 10 is removably mounted in operative relation to a flying wheel printer of the type having a rotatable print wheel 13 with a plurality of character pads 14 each mounted on the outer end of a different one of a plurality of radial spokes 15. Spokes 15 are secured to a central hub 16 which is rotated by a drive motor (not shown). The cartridge houses an inked ribbon 18 which is threaded through a pair of conventional ribbon guide members 20, 21 each carried by platform 11. Ribbon guides 20, 21 position ribbon 18 in a print station defined by an aperture 22 in a plate 23 so that a character pad 14 presses ribbon 18 against the surface of a sheet of paper 24, or other suitable print receptor, resting on the surface of a platen 25 whenever a print hammer 26 is actuated.

Ribbon 18 is also maintained in contact with the outer surface of a conventional guide arm 27 which is pivotally mounted on platform 11 for motion in a plane substantially parallel with the axis of platen 25. A spring 28 secured between guide arm 27 and a post 29 fixed to platform 11 biases arm 27 outwardly of the ribbon loop. Guide arm 27 provides a yieldable ribbon surface guide in the event the ribbon 18 is accelerated at a very high rate.

Figure 2:
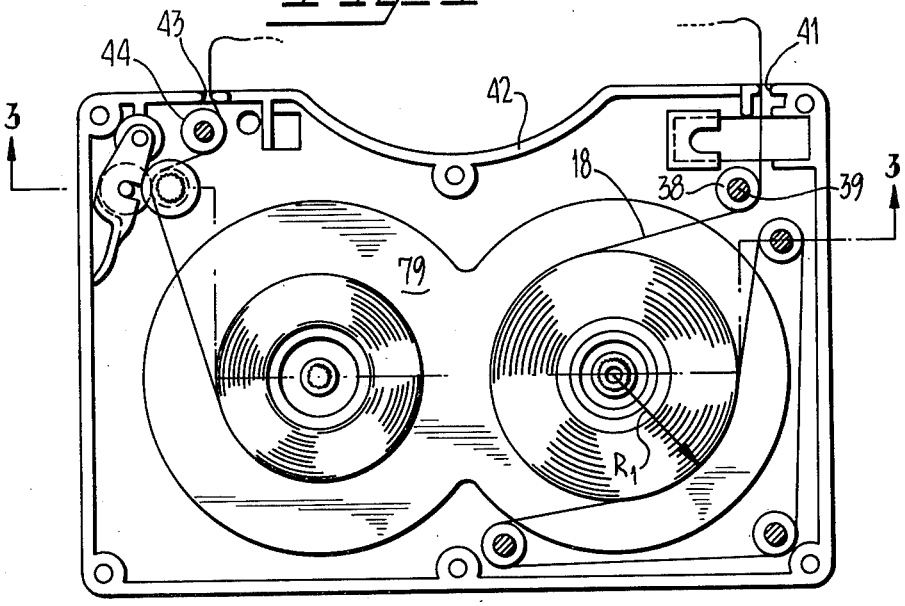
FIG. 2 is a top plan view of the invention of FIG. 1 with the cover removed.
Figure 3:
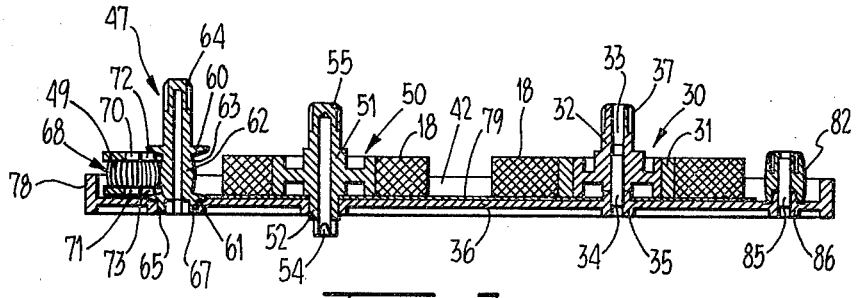
FIG. 3 is a sectional view taken along lines 3—3 of FIG. 2.

With reference to FIGS. 2 and 3, cartridge 10 includes a supply reel assembly 30 comprising an an annular core 31 in to which a hub portion 32 is press fitted. Hub portion 32 has a central bore 33 having a diameter slightly larger than the outer diameter of a support pin 34 which is press fitted into a reinforced aperture 35 in the bottom wall 36 of the cartridge casing. Ribbon 18 is wound about annular core 31 in a clockwise fashion, with the inner end of the ribbon 18 fastened to the outer surface of core 31 by any suitable means, e.g., adhesive. Supply reel assembly 30 further includes an upwardly projecting stem portion 37 having a substantially cylindrical grooved outer surface and sufficient length to protrude above the top surface of cartridge 10 for permitting manual rotation of reel assembly 30. The leading edge of ribbon 18 is passed around an idler roller 38 rotatably mounted on a pin 39 press fitted into a reinforced aperture in bottom wall 36 of the cartridge casing in a similar manner to pin 34. The ribbon emerges from cartridge 10 through an outlet slot 41 formed in the front wall portion 42 and re-enters cartridge 10 through an entry slot 43 also formed in wall 42. The re-entrant portion of the ribbon is passed around a guide 44, which is preferably stationary, and between a ribbon capstan 47 and pinch roller 49 to the take-up reel 50.

Take-up reel 50 is a unitary member having a hollow central portion 51 terminating at the lower end 52 thereof in a suitably configured notch 54 for embracing the driving end of a mating drive spindle (not shown) to enable take-up spool assembly 50 to be driven in the counter-clockwise direction as viewed in FIG. 2. The leading edge of inked ribbon 18 is secured to the outer surface of take-up reel 50 by any suitable means, e.g., adhesive. Take-up reel 50 further includes an upwardly projecting stem portion 55 having a substantially cylindrical grooved outer surface and sufficient length to protrude about the top surface of cartridge 10 for permitting manual rotation of reel assembly 50.

Figure 5:
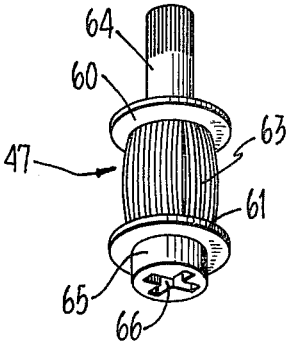
FIG. 5 is a bottom perspective view of the ribbon capstan of the preferred embodiment.
Figure 6:
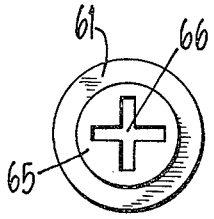
FIG. 6 is a bottom plan view of the ribbon capstan shown in FIG. 5.

Ribbon 18 is withdrawn from supply reel assembly 30 by the combined action of ribbon capstan 47, pinch roller 49 and a biasing member 56. As best shown in FIGS. 3, 5 and 6, ribbon capstan 47 in a unitary member having a pair of axially spaced flanges 60, 61 and a central body portion 62 located therebetween. Body portion 62 has a grooved convex surface 63 for gripping ribbon 18. Projecting upwardly from the upper surface of flange 60 is a stem portion 64 having a substantially cylindrical grooved outer surface of sufficient length to protrude above the top surface of cartridge 10 for permitting manual rotation of ribbon capstan 47. Extending below flange 61 is a substantially cylindrical base portion 65 having a decussate aperture 66 adapted to receive a mating drive member (not shown) in order to effect rotation of capstan 47 in the counterclockwise direction as viewed in FIG. 2. As best shown in FIG. 3, base portion 65 is rotatably received in a reinforced aperture 67 formed in bottom wall 36 of the cartridge casing.

Pinch roller 49 is a unitary member having a grooved convex surface 68 for gripping ribbon 18, and a pair of oppositely extending axle stubs 70, 71 which are received in upper and lower slots 72, 73 in biasing member 56. Biasing member 56 has an end portion 75 pivotally mounted on a pivot post 76 secured to the cartridge housing and a resilient arm 77 which is normally in flexing contact against the inner surface of adjacent sidewall 78 of the cartridge housing in order to provide a yieldable biasing force for pinch roller 49 urging this latter element into engagement with drive surface 63 of ribbon capstan 47.

Both supply reel assembly 30 and take-up reel 50 rest on a low friction slip plate 79 fabricated from graphite-coated Mylar or other equivalent materials to provide a low friction support for the bottom surface thereof.

Mounted adjacent supply reel assembly 30 is a ribbon tensioning mechanism which comprises an endless elastic belt 80 arranged about three freely rotatably idler wheels 82–84. Idler wheels 82–84 are all similar in construction, and as illustrated in FIG. 3 for idler wheel 82 comprise a unitary member rotatably received on a fixed pin 85 which is press fitted into a corresponding reinforced aperture 86 in bottom wall 36 of the cartridge housing.

Elastic tensioning belt 80, preferably constructed from a material such as polyurethane, is maintained in surface contact with the outermost layer of ribbon 18 on supply reel assembly 30 in a region intermediate idler wheels 82, 84, hereinafter designated the interference region. As best shown in FIG. 2., when the supply reel assembly 30 contains the major portion of ribbon 18, belt 80 is highly stretched in the interference region by the large supply ribbon radius R1. The correspondingly large deflection of belt 80 provides a drag force of a relatively large magnitude directed centrally of supply reel assembly 30 which tends to oppose rotation of the latter in the clockwise direction. In contrast, when a major portion of the inked ribbon 18 has been payed out and wound on take-up reel 50 (FIG. 4), the diminished ribbon radius R2 deflects belt 80 a corresponding smaller amount, and belt 80 provides a reduced drag force on supply reel assembly 30. It should be noted that the optimum parameters of belt 80, such as length, width and elasticity, can best be determined on an empirical basis for any given application.

Figure 4:
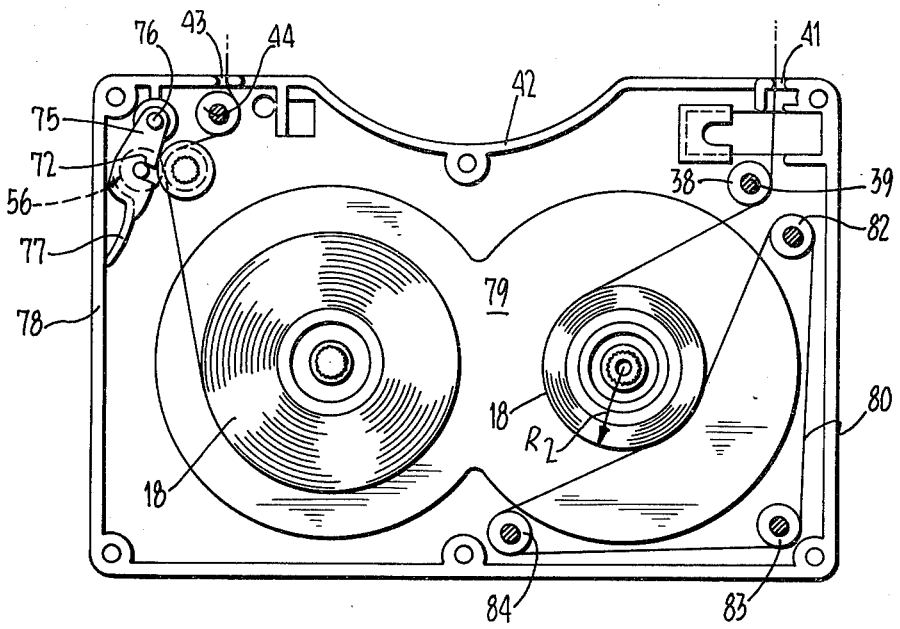
FIG. 4 is a top plan view similar to FIG. 2 with a substantial portion of the ribbon removed from the supply reel.

In operation, cartridge 10 is first mounted onto platform 11 and ribbon 18 is threaded through guides 20, 21 and onto the take-up reel 50 forming a loop externally of cartridge 10. Next, shaft portions 37, 55 and 64 are manipulated to remove any slack from ribbon 18. Drive mechanism 12 is then actuated to rotate ribbon capstan 47 and take-up reel assembly 50. As ribbon capstan 47 and pinch roller 49 rotate, ribbon 18 is withdrawn from supply reel assembly 30 in response to the ribbon capstan pulling force, is translated past the print station and is wound about take-up reel 50. As supply reel assembly 30 rotates, belt 80 is transported about rollers 82–84 by the surface friction between the outer surface of those portions of belt 80 and ribbon 18 in the interference region. Initially, the relatively large supply ribbon radius R1 produces a large deflection of elastic belt 80 in the interference region which causes a correspondingly large drag force on supply reel assembly 30 (FIG. 2). As the quantity of ribbon 18 on supply reel assembly 30 decreases, the supply ribbon radius likewise decreases and thus the drag force provided by the deflected portion of belt 80 in the interference region diminishes (FIG. 4). Since the pulling force on ribbon 18 increases with decreasing supply ribbon radius R and the drag force provided by belt 80 decreases in a corresponding fashion, the tension in ribbon 18 is maintained substantially constant as ribbon 18 is payed out from supply reel assembly 30 to take-up reel 50. During the ribbon reeling operation, sudden acceleration of ribbon 18 is compensated by guide arm 27 which yields inwardly in response to sudden acceleration and moves outwardly under the action of spring 28 in response to sudden deceleration.

As will now be evident, the above described invention provides an ink ribbon cartridge which is inexpensive to fabricate and which provides substantially constant ribbon tension over the entire useful range of the ribbon supply. It is noted that once the entire ribbon 18 has been payed out from supply reel assembly 30, the cartridge may be removed and discarded and a new cartridge installed. Alternatively, supply reel assembly 30 and take-up reel 50 may be removed, and a new empty take-up reel 50 and supply reel assembly 30 with a fresh ribbon may be installed in the used cartridge housing. Further, if the usefulness of the used ribbon 18 has not markedly deteriorated during the ribbon payout operation, the ribbon may be rewound and reused. It is further noted that the ribbon tensioning mechanism avoids sliding frictional contact against the surface of ribbon 18 which would tend to remove ink therefrom and would also tend to increase the torque requirements of the driving mechanism 12.

While the above provides a full and complete disclosure of the preferred embodiment, various modifications, alternate constructions and equivalents may be employed without departing from the spirit and scope of the invention. Therefore, the above should not be construed as limiting the invention, which is defined by the appended claims.

What is claimed is:

1. A cartridge for supplying an inked ribbon to a printing station in an associated printing apparatus, said cartridge comprising:

a housing having a ribbon entrance and a ribbon exit;

a first reel rotatably mounted above a fixed axis in said housing for providing a supply core for an inked ribbon adapted to be wrapped thereabout;

a second reel rotatably mounted in said housing for providing a take-up core for an inked ribbon adapted to be wrapped thereabout;

ribbon transport means positioned adjacent said ribbon entrance for providing a force for translating said ribbon from said first reel to said second reel via said exit and said entrance; and means adjacent said first reel for providing a drag force on said first reel to maintain the tension in said rubber substantially uniform in said printing station substantially independently of the quantity of ribbon on said supply core; said drag force means comprising a plurality of freely rotatable idler members defining a belt path, and an elastic belt disposed about said idler members along said path for translation therealong, a portion of said path defining an interference region in which the surface of a portion of said belt located therein engages the outer layer of supply core mounted ribbon encountered therein so that said belt is deflected thereby.

2. The apparatus of claim 1 further including means positioned between the bottom edges of said ribbon on said supply and take-up cores and the upper surface of the bottom wall of said cartridge for providing a relatively low friction support surface for said edges of said ribbon.

3. The apparatus of claim 1 wherein said ribbon transport means includes a capstan member rotatably mounted in said housing, said capstan member having a pair of axially spaced flanges and a curved surface portion therebetween, said surface portion having a serrated wall surface; a pinch roller rotatably mounted in said housing and having a curved intermediate serrated surface portion and a pair of oppositely extending stub axles; and a bias member pivotally mounted in said housing and having a pair of spaced slots for embracing said stub axles and a resilient arm engageable with the inner surface of an adjacent side wall of said cartridge for biasing said serrated surface portion of said pinch roller toward said serrated wall surface of said capstan member so that said ribbon is grasped therebetween.

4. The apparatus of claim 3 further including a curved ribbon guide member positioned adjacent said entrance.

5. The apparatus of claim 1 further including a rotatable ribbon guide member positioned adjacent said exit.

6. The apparatus of claim 1 wherein said first and second reels and said ribbon transport means each include a central shaft member protruding exteriorly of said cartridge housing for enabling manual rotation of said reels and said ribbon transport means.

7. In combination with a printing device having a pair of ribbon guides defining a printing station, a cartridge for supplying a translatable inked ribbon to said printing station, said cartridge comprising:

a housing having a ribbon entrance and a ribbon exit;

a first reel rotatably mounted about a fixed axis in said housing for providing a supply core for an inked ribbon adapted to be wrapped thereabout;

a second reel rotatably mounted in said housing for providing a take-up core for an inked ribbon adapted to be wrapped thereabout;

ribbon transport means positioned adjacent said ribbon entrance for providing a force for translating said ribbon from said first reel to said second reel past said printing station via said ribbon exit and said ribbon entrance; and means adjacent said first reel for providing a drag force thereon to maintain the tension in said ribbon located in said printing station substantially uniform substantially independently of the quantity of ribbon on said supply and said take-up cores, said drag force means comprising a plurality of freely rotatably idler members defining a belt path, and an elastic belt disposed about said idler members along said belt path for translation therealong, a portion of said belt path defining an interference region in which the surface of portions of said belt located therein engages the outer layer of supply core mounted ribbon encountered therein so that said belt is deflected thereby.

8. The combination of claim 7 further including means positioned between the bottom edges of said ribbon on said supply and take-up cores and the upper surface of the bottom wall of said cartridge for providing a relatively low friction support surface for said edges of said ribbon.

9. The combination of claim 7 wherein said ribbon transport means includes a capstan member rotatably mounted in said housing, said capstan member having a pair of axially spaced flanges and a curved surface portion therebetween, said surface portion having a serrated wall surface; a pinch roller rotatably mounted in said housing and having a curved intermediate surface portion and a pair of oppositely extending stub axles; and a bias member pivotally mounted in said housing and having a pair of spaced slots for embracing said stub axles and a resilient arm engageable with the inner surface of an adjacent sidewall of said cartridge for biasing said serrated surface portion of said pinch roller towards said serrated wall surface of said capstan member so that said ribbon is grasped therebetween.

10. The combination of claim 9 further including a stationary curved ribbon guide member positioned adjacent said ribbon entrance.

11. The combination of claim 7 further including a rotatable ribbon guide member positioned adjacent said ribbon exit.

12. The combination of claim 1 wherein said first and second reels and said ribbon transport means each include a central shaft member protruding exteriorally of said cartridge housing for enabling manual rotation thereof.

13. The combination of claim 7 further including a guide arm pivotally mounted on said printing device adjacent one of said pair of ribbon guides, and means for biasing said guide arm in a direction outwardly of said printing station, said guide arm and said biasing means providing a tension relief for said ribbon when said ribbon is subjected to sudden acceleration.

* * * * *